United States Patent [19]

Nichols et al.

[11] 3,972,373

[45] Aug. 3, 1976

[54] FIRE EXTINGUISHER SYSTEM FOR VEHICLE

[76] Inventors: Kenneth B. Nichols; Josephine E. Nichols, both of 1813 Towhee, San Marcos, Calif. 92069

[22] Filed: Aug. 25, 1975

[21] Appl. No.: 607,144

[52] U.S. Cl. ..... 169/62; 239/112

[51] Int. Cl.[2] ..... A62C 35/12

[58] Field of Search ..... 169/62, 71; 285/315, 285/316; 296/23 R, 28 C; 180/89 A; 239/112

[56] References Cited

UNITED STATES PATENTS

| | | | |
|---|---|---|---|
| 1,493,327 | 5/1924 | Dunbar | 169/62 |
| 1,616,974 | 2/1927 | Josephson | 169/62 |
| 1,744,733 | 1/1930 | Beames | 169/62 |
| 2,291,617 | 8/1942 | Freygang | 169/62 X |
| 2,565,572 | 8/1951 | Pangborn | 285/316 X |
| 2,756,829 | 7/1956 | Phillips | 169/62 |
| 2,841,228 | 7/1958 | Porterfield | 169/62 X |
| 3,259,194 | 7/1966 | McCrossan | 169/71 |
| 3,348,774 | 10/1967 | Wiggins | 239/112 X |
| 3,464,497 | 9/1969 | Globerman et al. | 169/62 X |
| 3,515,218 | 6/1970 | Gardner et al. | 169/62 X |
| 3,583,518 | 6/1971 | Bichel et al. | 180/89 A |
| 3,873,023 | 3/1975 | Moss et al. | 239/112 X |

OTHER PUBLICATIONS

Johnston, J. H. *Design for Custom Built House Car Body for a Forward Drive Chassis*, in *Autobody and the Reconditioned Car*, vol. 29, No. 5, pp. 8 & 71, 1950.

*Primary Examiner*—John J. Love
*Assistant Examiner*—Andres Kashnikow
*Attorney, Agent, or Firm*—Duane C. Bowen

[57] ABSTRACT

A standard fire extinguisher is modified by providing a quick-disconnect coupling interposed in its hose, so that its nozzle can be disconnected and the coupling can be connected to a mating quick-disconnect coupling exposed on a bonnet or the like covering a vehicle engine. The bonnet may be in the passenger compartment of the vehicle and opens to provide engine access. Tubing, inside the bonnet and connecting to the coupling on the bonnet, has discharge openings to distribute fire extinguishing fluid in fighting a fire in the engine compartment.

5 Claims, 7 Drawing Figures

FIRE EXTINGUISHER SYSTEM FOR VEHICLE

BRIEF SUMMARY OF THE INVENTION, BACKGROUND, AND OBJECTIVES

Our invention relates to means to fight fires in an engine compartment of a vehicle and is designed for use in a vehicle having an engine covered with a bonnet or the like, often disposed in the vehicle passenger compartment. The bonnet is opened for engine access and our system is designed to fight a fire in the engine compartment without opening the bonnet.

When the word "vehicle" is used herein it is meant to include air and water vehicles, as well as land vehicles such as motorhomes, vans and trucks. An application to a water vehicle is to a boat having an inboard motor having a hatch type covering for the engine compartment. The hatch is similar to a bonnet in a land vehicle in normally closing the top of the engine compartment and opening for engine access. The hatch may be located inside or outside of the boat cabin.

To set forth the background of the invention, the inventors' motorhome caught fire and caused about $2000.00 damage to the engine. This happened in a residential area and proved to be very difficult to extinguish, in spite of the following circumstances:

1. A man with a garden hose was watering his lawn less than 10 feet from the motorhome and water from the hose was used on the fire.
2. A 5 pound dry chemical fire extinguisher was in the motorhome and was used.
3. An off-duty fireman, living one-half block away, noted the fire and immediately called the local fire department.
4. That fireman drove to the fire bringing his own 5 gallon extinguisher which he used. He also provided fire fighting expertise.
5. A fire truck and three firemen promptly arrived who were then successful in putting out the fire. They donned masks before opening the engine compartment inside of the motorhome.

Because of the foregoing circumstances, including proximity of the fire department, the damage, although considerable, was confined primarily to the engine compartment. If the fire had taken place on the open road, conceivably the entire motorhome would have been destroyed.

The inventors' motorhome has in common with many other motorhomes and vans and with certain trucks and inboard motor boats: (a) difficult access to the engine compartment in time of fire and (b) exposure of the passenger compartment to such a fire. Commonly in such motorhomes and vans, and sometimes in trucks, the engine compartment is located underneath the passenger compartment, sometimes between the front seats of the vehicle. It is covered with a bonnet or cover which is removed or opened to provide basic engine access. If the bonnet is opened to provide access for engine fire fighting, extra oxygen can reach the fire, the fire can spread to the passenger compartment and gaseous products of combustion freely pass into the passenger compartment. It is better not to open the bonnet in case of fire unless there is an experienced fireman available equipped with a mask and a plentiful supply of a fire extinguishing medium, so that the fire can be immediately extinguished and the whole interior of the vehicle won't be engulfed.

Note in such engine installations that the front of the engine compartment usually is substantially covered by a radiator, so that most fire extinguishing medium applied from the front will be blocked by the radiator. The only satisfactory access to such engine compartments for fire fighting is via the bonnet. When the engine cover is opened, the fire will be greatly intensified and the usual fire extinguisher on motorhomes and boats will be inadequate to take care of the intensified fire. Nevertheless, owners will often open the bonnet, although they risk not only loss of the motorhome or boat but also personal physical injury.

The objects of our invention include: to provide a fire extinguishing system adapted to solve the problems described above, to solve the problem of engine inaccessibility, to adapt the system to the use of the same type of dry chemical fire extinguishers required by the laws of most states to be carried on motorhomes and boats but to design the system so that the same fire extinguisher can be used for other than engine fires in or about the vehicle or boat, to design a system operating without risking intensifying of fire and spreading of fire to the passenger compartment due to opening of the bonnet, to provide a system operative without risk of personal physical injury, to provide for maintenance of the system in operative working order and to devise a system in apparatus and operation, economical in cost and adaptable to existing vehicles as well as newly constructed vehicles.

Our invention will be best understood together with additional objectives and advantages thereof, from the following description, read with reference to the drawings, in which.

Figure 1:
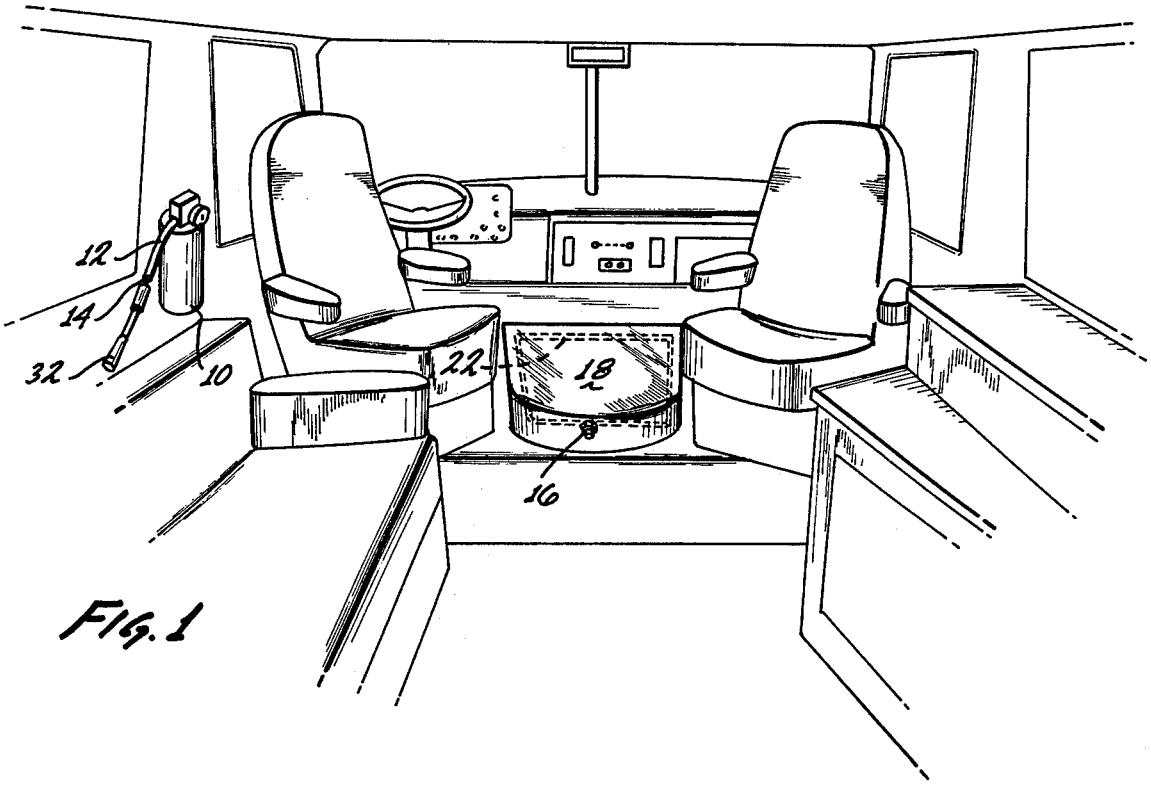
FIG. 1 is a perspective view of the interior of a typical motorhome, showing a specific embodiment of our invention.

In operation, the principal components of the system include fire extinguisher 10, having a hose 12 connected by male quick-disconnect coupling member 14 (sometimes commonly called an "insert"), a female quick-disconnect coupling 16 (sometimes commonly called a "body"), exposed outside bonnet 18 over engine 20, and a tubing loop 22 inside the bonnet having openings 24 to discharge a fire extinguishing medium on an engine fire.

The fire extinguisher 10 is a standard product. The drawings depict one of the common types on the market, i.e., one identified as "safe-T-meter 5", manufactured by Safety First Products Corporation of Cornwells Heights, Pa., a dry chemical fire extinguisher, recharged at 350 psi according to directions with 5 pounds of "Safety First Free Flo Dry Chemical", as a powder, and with nitrogen as a compressed gas medium. The selection of a fire extinguisher is optional, of course, but a dry chemical would appear preferable for an engine fire.

Many fire extinguishers, at least of the 5 pound class or larger, will be supplied with a hose 12 having screw coupling 30 to a fitting on the fire extinguisher 10, and having a nozzle 32 for directing discharge on a fire. Our modification of a fire extinguisher hose 12 is to interpose insert 14 and a female quick-disconnect coupling or body 34 intermediate the ends of hose 12 so that the fire extinguisher may be supported on a bracket or otherwise can be stored in the motorhome or other vehicle and be available with nozzle 32 attached for general fire fighting usage. When the extinguisher is to be used to put out an engine fire, insert 14 is disengaged from body 34 and engaged with body 16 exposed outside bonnet 18, whereupon the extinguisher is operated by usually disengaging locking means and squeezing handle means 36. If the standard fire extinguisher does not come with a hose, a modification needs to be made including, as a minimum, a hose 12, means 30 to attach the hose to the extinguisher, and insert 14 on the end of the hose. The provision of body 34 and nozzle 32 is optional. Connection 30 could be of a quick-disconnect type instead of a screw type, but the screw type is common and suitable for the configuration shown. The general requirements are the ability to quickly discharge a fire fighting medium from the extinguisher 10 to the distribution system 22 in the case of an engine fire and the availability of the extinguisher 10 for use on other fires (i.e., on the interior of the vehicle) at other times.

The concept of dual use of fire extinguisher 10 adapted for general firefighting and specifically adapted for the special requirements of engine fires, is most important, because both are badly needed but it is believed most owners of applicable vehicles will not buy both systems. The fact that most motorhomes have a fire extinguisher at present is because of a requirement in most states, and the presence of fire extinguishers in boats may be the result of the Coast Guard or other governmental regulations having power to regulate those boats. Apart from the problem of motivating vehicle owners to buy, dual capacity is important for economy and reduced maintenance (perhaps one extinguisher will be periodically serviced).

As has been indicated, mating quick-disconnect inserts and bodies, such as parts 14, 16 and 34, are very common articles and are so well known that details of structure will not be given as being superfluous. An example would be the Milton "Kwick Change" Coupling, Milton Mfg. Co., 1900 W. Hubbard, Chicago, Ill. These couplings are connected and disconnected by moving a locking sleeve 40, camming locking balls 42, on the body, relative to a groove 44 on the insert.

As has been indicated, most applicable land vehicles have a bonnet 18 or the like covering engine 20 between the vehicle front seats. In the case of a boat, the cover 18 may be a hatch covering the engine, inside or outside of the passenger compartment. It is imperative in the case of an engine fire that the bonnet or hatch be kept closed, to limit oxygen supply and to avoid spreading of the fire through the opening provided by an opened or removed bonnet or hatch. We provide exposed outside of the cover 18 a body 16. Note that most fire extinguishers work best in an upright position. Therefore, body 16 should be so located and hose 12 should have such length that fire extinguisher 10 can be operated in an upright position.

The body 16 connects through opening 50 in cover 18 to means to disperse the fire extinguishing medium in the engine compartment 52. This can take a number of forms, may be differently configured for various installations, etc. The form shown is a tube 22 that makes a complete loop from a T-fitting 54 connected to body 16. Tube 22 has a series of spaced apart openings 24 to direct the fire fighting medium down in compartment 52 around engine 20. Note that, say, a 5 pound extinguisher, discharging into a partly confined space 52, should be a more than ample system, i.e., the volume of medium per volume of fire space. A person fighting a fire probably would use only part of the extinguisher capacity at first and leave the extinguisher connected for more applications if the fire should rekindle. Of course space 52 will be somewhat open below the engine and via the radiator space from in front, but the engine will be considerably enclosed. Hot gases rise, so as long as the top of compartment 52 is closed, supply of new (cold) air from below is somewhat limited. The air having the oxygen will have a tendency not to rise in compartment 52 as long as the top of the compartment is closed and low pressure due to hot air escape is not present.

One way to support tubing 22 is by clips 60 secured by bolts or screws 62 to the underside of bonnet 18.

Figure 2:
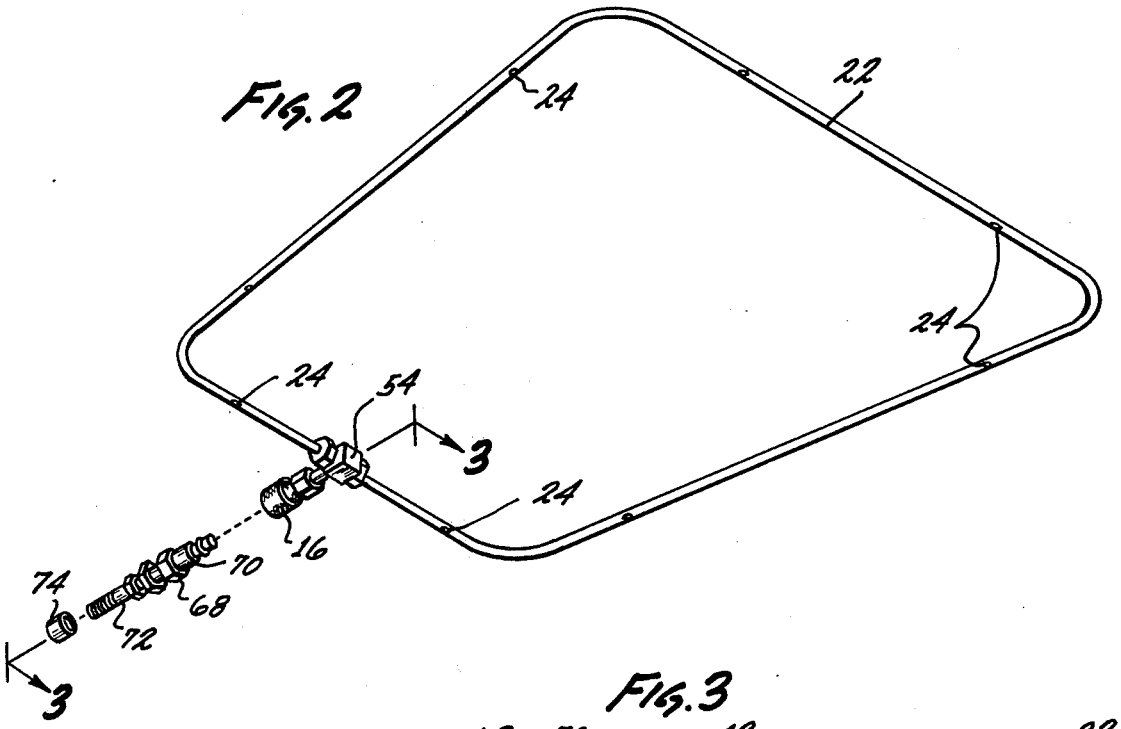
FIG. 2 is a perspective view, on enlarged scale, of a portion of the fire extinguishing system and also showing, in removed position, an air inlet member that can be connected for the purpose of periodically blowing out the system with a service station compressed air source.
Figure 3:
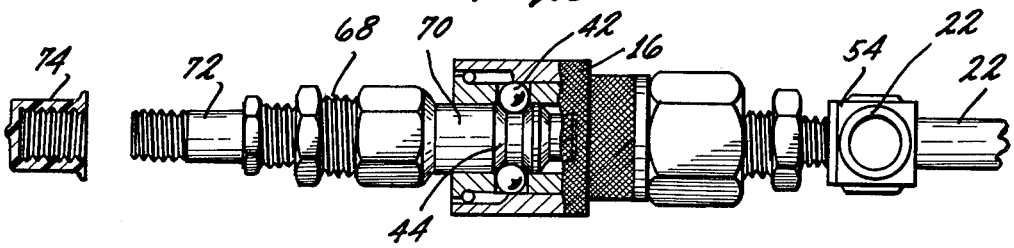
FIG. 3 is an enlarged view, partly in section, taken generally on line 3 — 3 of FIG. 2, showing the air inlet member connected with the quick-disconnect coupling shown in FIG. 2.
Figure 4:
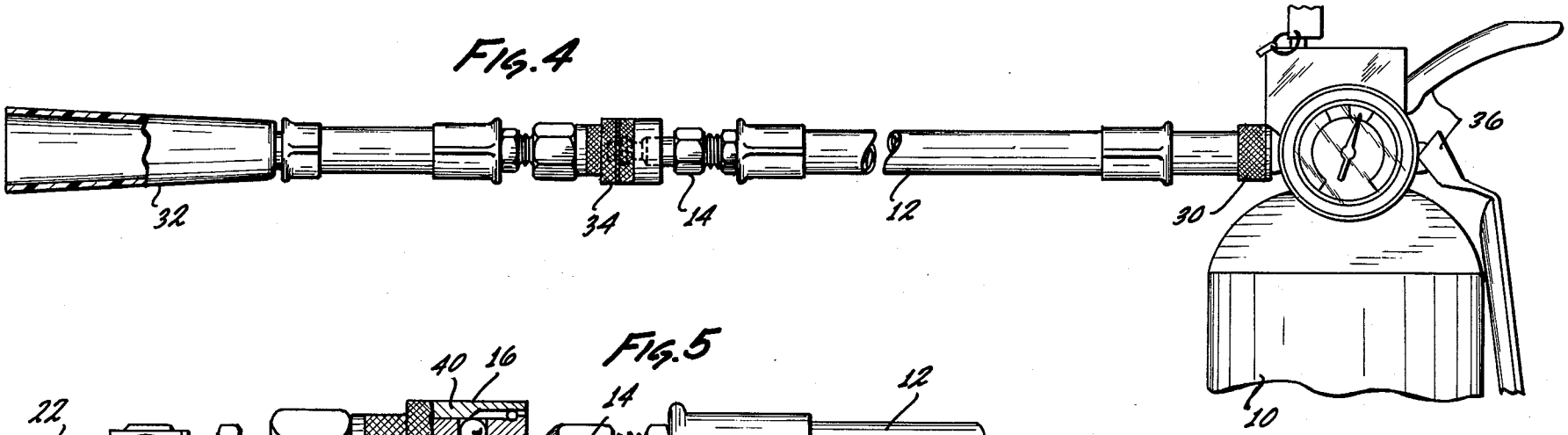
FIG. 4 is a side view, with certain portions broken-away, showing a fire extinguisher and a nozzle, connected thereto by quick-disconnect coupling means, for normal fire fighting purposes.
Figure 7:
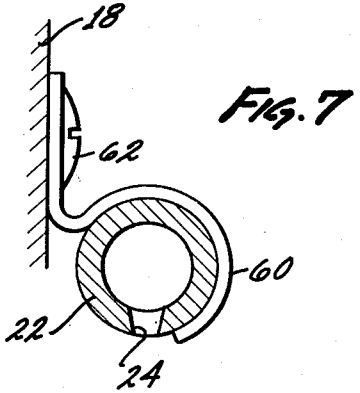
FIG. 7 is an enlarged view, partly in section, taken on line 7 — 7 of FIG. 6.
Figure 5:
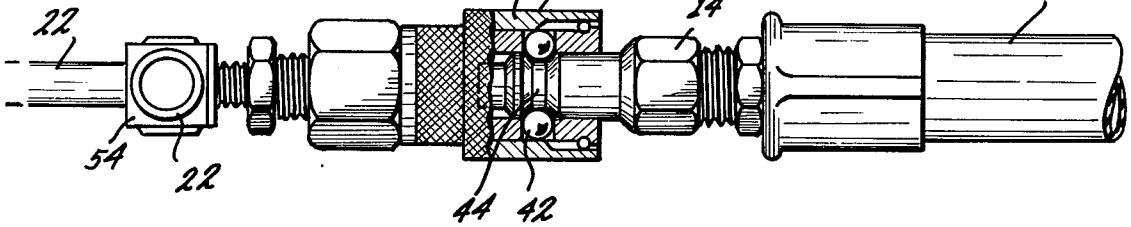
FIG. 5 is an enlarged view, partly in section, showing the connecting, with quick-disconnect couplings, of the fire extinguisher hose to the fluid distribution member shown in FIG. 2.
Figure 6:
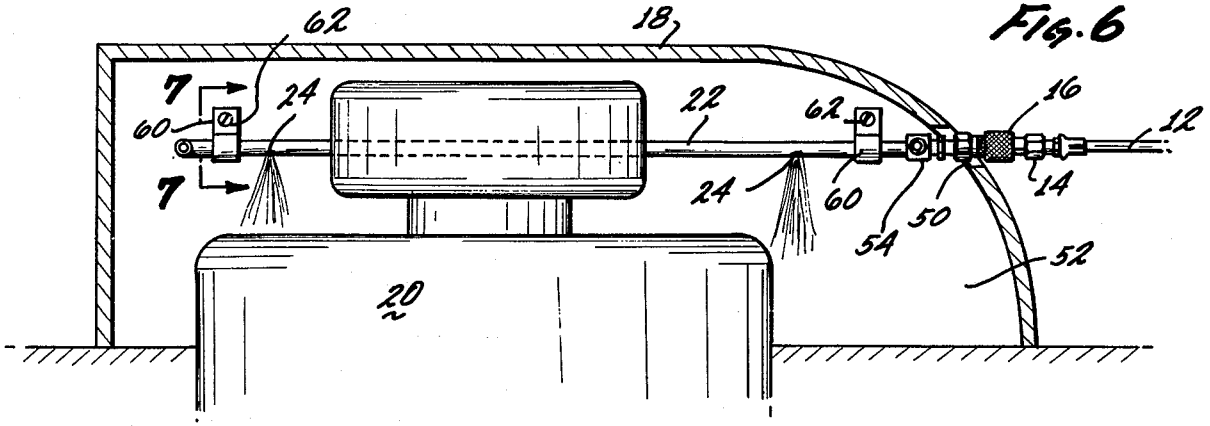
FIG. 6 is a side view, partly in section, through the bonnet, over an engine, viewed in FIG. 1.

After usage and periodically, tube 22 should be blown out to insure against blockage. As indicated in FIGS. 2 and 3, we provide air inlet means 68 having an insert 70 mating with body 16 and connected thereto an air inlet valve 72 (having the usual removable cap 74) of the type used in tires. Whenever it is desired to purge tube 22, insert 70 is engaged in body 16 and a service station compressed air hose can be used to discharge air through tube 22 and out openings 24, via valve 72.

The apparatus and operations of our system have been explained above. It will be observed we have provided a system that can be installed in existing or new vehicles. It is economical in being simple and by permitting dual fire fighting use of extinguisher 10. The system appears to have maximum effectiveness and adaptability for fighting an engine fire. Maintenance is minimized, i.e., periodically blowing out tube 22 and checking the extinguisher.

Having thus described our system, we do not wish to be understood as limiting ourselves to the exact details of construction shown. We instead wish to cover modification of our system that will occur to those skilled in the art upon learning of our invention, and properly within the scope of our invention.

We claim:

1. A fire extinguishing system for an engine in a vehicle having engine enclosing means forming an engine compartment, said engine enclosing means including a covering member over the engine forming upper enclosing means for the engine and opening for engine access, comprising:

a. means forming fluid distribution means disposed under said covering member and having discharge openings to said engine compartment, b. connecting means extending from said fluid distribution means to outside of said engine compartment and including inlet means, c. a standard container of fire extinguishing fluid having discharge means including a hose operative to feed fire extinguishing fluid to said inlet means, whereby upon the occasion of a fire in said engine compartment fire extinguishing fluid from said container can be discharged into said compartment without opening said covering member, d. said discharge means including a quick-disconnect coupling member at the end of said hose and said inlet means being a quick-disconnect coupling member mating with said quick-disconnect coupling member at the end of said hose, whereby said container can be quickly connected to said fluid distribution means in event of a fire, e. said vehicle having space for occupants and said covering member being a bonnet and being located within said space for occupants, whereby upon the occasion of a fire if said bonnet is opened to fight a fire in said engine compartment oxygen is supplied to the fire from said space for occupants and said space for occupants is exposed to fire, and f. said fluid distribution means being secured to the underside of said bonnet and said bonnet having an opening through which said connecting means extends.

2. A fire extinguishing system for an engine in a vehicle having engine enclosing means forming an engine compartment, said engine enclosing means including a covering member over the engine forming upper enclosing means for the engine and opening for engine access, comprising:

a. means forming fluid distribution means disposed under said covering member and having discharge openings to said engine compartment, b. connecting means extending from said fluid distribution means to outside of said engine compartment and including inlet means, c. a standard container of fire extinguishing fluid having discharge means including a hose operative to feed fire extinguishing fluid to said inlet means, whereby upon the occasion of a fire in said engine compartment fire extinguishing, fluid from said container can be discharged into said compartment without opening said covering member, d. said discharge means including a quick-disconnect coupling member at the end of said hose and said inlet means is a quick-disconnect coupling member mating with said quick-disconnect coupling member at the end of said hose, whereby said container can be quickly connected to said fluid distribution means in event of a fire, e. said vehicle being an automotive vehicle having a passenger compartment and said covering member being a bonnet and being located within said passenger compartment, whereby upon the occasion of a fire if said bonnet is opened to fight a fire in said engine compartment oxygen is supplied to the fire from said passenger compartment and said passenger compartment is exposed to said fire, and f. said fluid distribution means being secured to the underside of said bonnet and said bonnet having an opening through which said connecting means extends.

3. The subject matter of claim 2 in which said fluid distribution means has the form of a loop of tubing connecting at each end to said connecting means and extending inside the margins of said bonnet, and said discharge openings including holes in said tubing at spaced intervals throughout its length.

4. The subject matter of claim 2 in which there is an air injection member having at one end a quick-disconnect coupling member mating with said quick-disconnect coupling member of said inlet means and having at its other end air inlet means, whereby said fluid distributions means can be periodically blown out to insure operability by connecting a pressurized air source, to said air inlet means, of the type commonly provided to inflate tires at automotive service stations.

5. The subject matter of claim 2 in which there is a second hose having at one end a quick-disconnect coupling mating with said quick-disconnect coupling attached to said first-mentioned hose, and said second hose has a nozzle at its other end, whereby said container can be used for general fire fighting purposes through use of said second hose and said nozzle except when it is desired to fight a fire in said engine compartment whereupon said second hose is disconnected and said first hose is connected to said inlet means.

* * * * *